US005580234A

United States Patent [19]

Wadensten

[11] Patent Number: 5,580,234

[45] Date of Patent: Dec. 3, 1996

[54] HYDRAULICALLY OPERATED ROTARY VIBRATOR

[76] Inventor: Theodore S. Wadensten, P.O. Box 8, Wyoming, R.I. 02898

[21] Appl. No.: 458,664

[22] Filed: Jun. 2, 1995

[51] Int. Cl.[6] ..... F03C 2/08; F01C 13/00

[52] U.S. Cl. ..... 418/181; 418/206.1; 366/128

[58] Field of Search ..... 418/181, 206.1; 366/124, 128

[56] References Cited

U.S. PATENT DOCUMENTS 2,988,338 6/1961 Fors et al. ..... 366/124

3,771,768 11/1973 Gebendinger ..... 366/128

*Primary Examiner*—John J. Vrablik

*Attorney, Agent, or Firm*—Patrick J. Pinto

[57] ABSTRACT

A hydraulically driven rotary vibrator that includes a motor body and a pair of opposed housings. Each housing includes a shaft, and an eccentric weight that are journalled by a pair of anti-friction bearings. The shaft of each housing extends a selected distance beyond a first end of the housing. A gear is attached to the extending end of the shaft. The gears associated with each of the housings are aligned and meshed with each other interior of the motor plate. The gears and their associated shafts are rotated when a hydraulic fluid is introduced into a motor chamber formed in the motor plate. The eccentric weights may be selectively phased for producing a determined vibratory output.

10 Claims, 1 Drawing Sheet

HYDRAULICALLY OPERATED ROTARY VIBRATOR

BACKGROUND OF THE INVENTION

1. Field of the Invention

With regard to the classification of art, this invention is believed to be found in the general class entitled MACHINE ELEMENTS OR MECHANISMS and more particularly to those subclasses pertaining to HYDRAULICALLY OPERATED ROTARY VIBRATORS.

2. Description of Related Art

Hydraulically operated rotary vibrators have been previously disclosed in the art. Generally the systems consist of at least one vibrator assembly that is coupled to an independent hydraulic motor. It has been found that this type of arrangement places a great deal of stress on the drive coupling. That stress generally results in failure of the connection. This type of arrangement is also energy inefficient, by needing to overcome the power requirements of the individual components. Another known arrangement directly attaches the hydraulic motor to a shaft of the rotary vibrator. This direct connection has been found to also have disadvantages. One of the known disadvantages is that the bearings of the hydraulic motor are prone to premature failure. These bearings generally are of the needle bearing type or the sleeve type because of size restrictions of the gear centers within the motor housing. The typical hydraulic motor is primarily rated on its torque rating. The rating and subsequent selection by torque alone may result in hydraulic motor that is undersized for the total of the vibratory forces that are developed. The selection of smallest hydraulic motor is attractive to a company because it reduces the cost of the vibrator assembly. Another disadvantage of this type of construction is the cost of the many components.

U.S. Pat. No. 2,988,338, issued to Fors et al on Jun. 13, 1961 discloses a rotary vibrator with an integral hydraulic motor. This patent was directed to reducing the cost associated with manufacturing hydraulically driven rotary vibrators. However this patent discloses a gear arrangement which may be described as a planetary arrangement. This planetary arrangement also has dimensional restrictions which also require the use of needle bearings. These small diameter needle bearings are also believed to be subject to a high failure rate.

The construction disclosed in the instant invention overcomes the problem of bearing failure by using large bearings. The construction of the vibrator disclosed in the instant invention also solves the problem of high cost that is associated with the production of the prior art hydraulically powered rotary vibrators. An unexpected benefit was realized with the construction of the present invention. This benefit allows the eccentrics to be adjusted relative to each other to provide a range of vibration forces. This range may be varied in increments from a minimum to a maximum value for a given size unit.

SUMMARY OF THE INVENTION

This invention may be briefly summarized as a hydraulically driven vibrator apparatus that comprises a pair of opposed housings and a motor body interposed therebetween. Each of the housings includes at least one closed end. Each of the housings has a cavity formed within. That cavity is adapted for allowing a rotational orbit by an eccentric weight therein. The eccentric weight is secured to a support shaft so that it is rotated as the support shaft is rotated. The support shaft is rotatably carried by the housing. At least one pair of anti-friction bearings is mounted and carried in precision bores at opposite ends of the housing. This arrangement provides a substantially stationary axis for the support shaft. Each of the anti-friction bearings is adapted for carrying the support shaft and its associated eccentric weight in a selected array. Each of the anti-friction bearings is selected and sized for withstanding anticipated vibratory forces. One end of the support shaft is arrayed for extending a selected distance beyond the one closed end. A gear member is secured to the one end of the support shaft. The pair of housings are arrayed in an opposed relationship with the motor body secured therebetween, the motor body has a selected configuration so that the gear member of one housing of the pair of housings is aligned and meshed with the gear member of the other housing of the pair of housings. The pair of gear members are aligned and meshed to provide for the rotation of the support shaft and the eccentric weight when a hydraulic fluid under a selected pressure flows through an inlet port of the apparatus. The inlet port directs the flow of the hydraulic fluid from a source of power to the gears that are aligned and meshed. An exhaust means is also provided for carrying hydraulic fluid under a reduced pressure away from the apparatus.

In addition to the above summary, the following disclosure is intended to be detailed to insure adequacy and aid in the understanding of the invention. However, this disclosure, showing particular embodiments of the invention, is not intended to describe each new inventive concept which may arise. These specific embodiments have been chosen to show at least one preferred or best mode for the hydraulically operated rotary vibrator of the present invention. These specific embodiments, as shown in the accompanying drawings, may also include diagrammatic symbols for the purpose of illustration and understanding.

Figure 1:
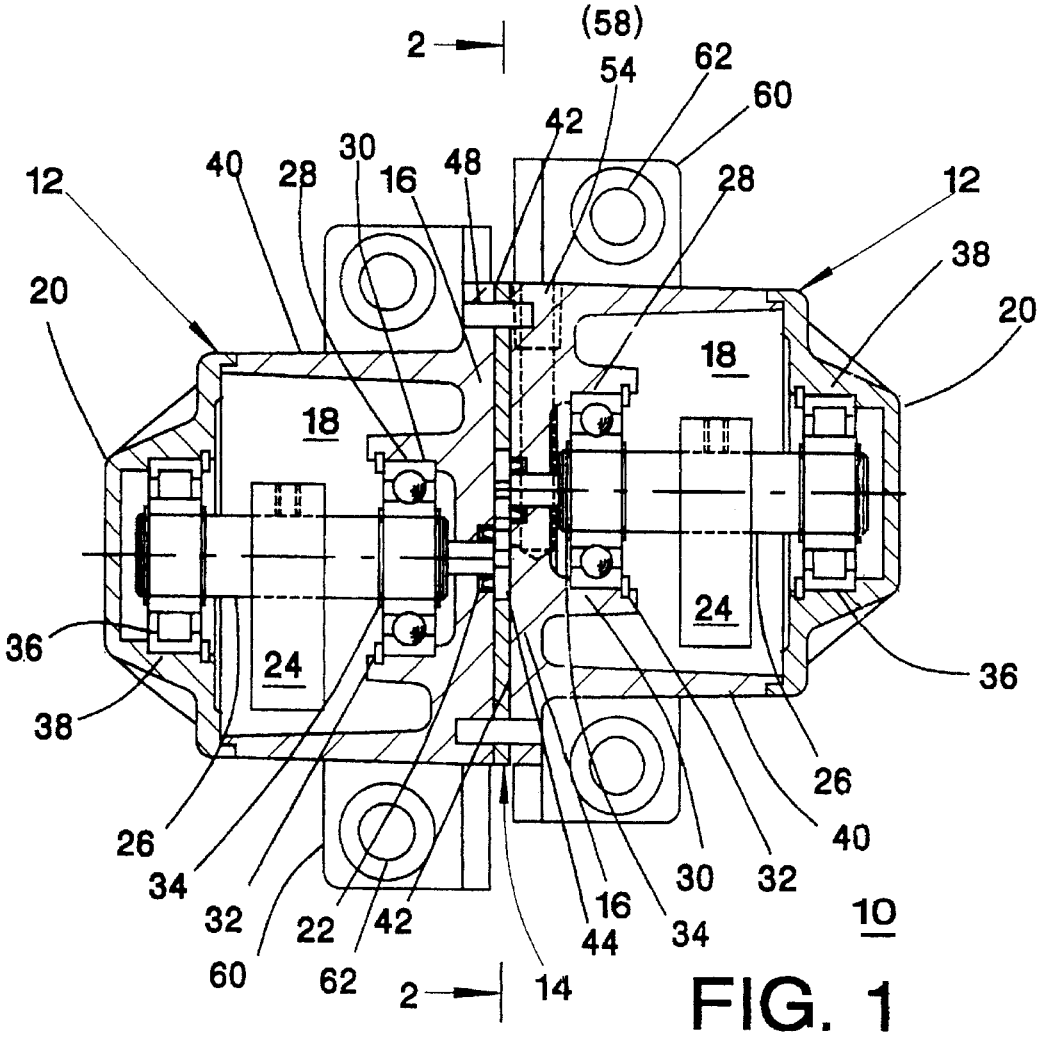
FIG. 1 represents a top view of the present invention, this view being partly schematic and partly in section.

In the following description and in the appended claims, various details are identified by specific names for convenience. These names are intended to be generic in their application while differentiating between the various details. The corresponding reference numbers refer to like members throughout the several figures of the drawing.

The drawing accompanying and forming a part of this specification disclose details of construction for the sole purpose of explanation. It is to be understood that structural details may be modified without departing from the concept and principles of the claimed invention. This invention may be incorporated into other structural forms than those that are shown.

DETAILED DESCRIPTION OF THE INVENTION

Figure 2:
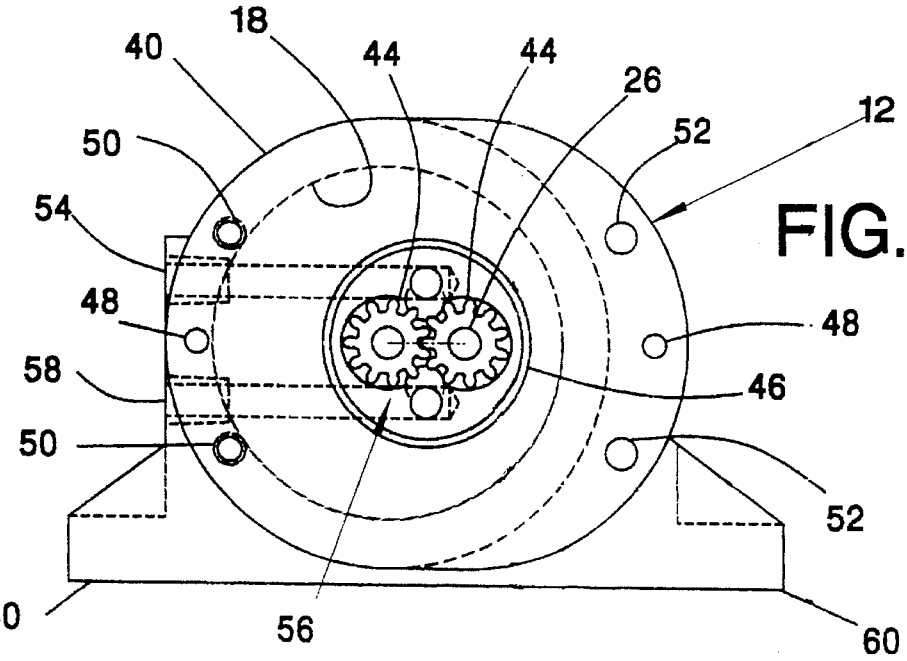
FIG. 2 represents a cross-sectional view of the present invention, This view being taken along line 2—2 of FIG. 1.

Referring to FIGS. 1 and 2, a hydraulically driven rotary vibrator assembly is generally identified as 10. This vibrator assembly 10 includes a pair of opposed vibrator housings 12 that are held in a predetermined spaced relationship by a motor body 14. It is preferred that each of the housings 12 be substantially the same. The purpose of this feature will become evident in the description below.

Each of the housings 12 includes a first end 16, a cavity portion 18 and a second end 20. The first end 16 which may also be described as a closed end. This means that selected penetrations through this first end 16 include a seal means, such as a shaft seal 22. The seal means is selected and positioned to resist leakage where exposure to anticipated hydraulic pressures exists.

The cavity portion 18 is adapted for allowing an eccentric weight 24 to rotate about its orbit center. The orbit center is coincident with an axis of a support shaft 26. The support shaft 26 is rotatably carried or journaled in the housing 12 by a pair of anti-friction bearings. It is preferred that a first or inner bearing 28 be of the type that retains the support shaft 26 in a precise alignment with the housing 12. One preferred type of anti-friction bearing is a pre-lubricated and sealed ball bearing. Other anti-friction bearings may be used that have a combined radial and thrust loading capability. The inner bearing 28 is securely held in a precision bore 30 by a suitable first retaining means 32 such as a retaining ring or the like. The support shaft 26 is precisely sized for a selected fit with the inner bearing 28. The support shaft 26 is located with respect to the inner bearing 28 by a pair of second retaining means 34 such as retaining rings or the like. This first retaining means 32 and second retaining means 34 must be configured so that movement of the inner bearing 28 and shaft 26 is minimized with respect to the first end 16.

The end of the support shaft 26 distal the inner bearing 28 is journaled in the second end 20 of the housing 12 by a second bearing 36 of the pair of bearings. This second bearing 36 is mounted in a precise bore 38. This type of mounting provides a precise location for the support shaft 26 in all of the directions that are transverse to the orbital axis. This second bearing 36 is also secured to the housing 12 and support shaft 26 by a retaining means similar to the first retaining means 32 and second retaining means 34. It is important that the support shaft 26, the inner bearing 28 and the outer bearing 36 be sized to withstand the forces developed during the orbital rotation of the eccentric 24. Preferably the second bearing 36 is a pre-lubricated and sealed roller bearing. This type of anti-friction bearing has been found to accurately located the support shaft in a direction that is transverse to the orbital axis. The use of a roller bearing also allows small increments of expansion in a direction that is parallel to the orbital axis. The small increments of expansion may develop as a result of the eccentrics being rotated about the orbital axis. It is best to minimize the distance between the center of the first bearing 28 and the center of the gear 44 for limiting the overall expansion.

It is preferred that the first end 16 and the walls 40 of the cavity 18 be integrally formed as a unitary part. This arrangement minimizes the manufacturing tolerances associated with a multiple part construction. The second end 20 may be removably attached to the walls 40. It is recommended that the removable attachment include a pilot arrangement.

One end of the support shaft 26 extends a selected distance beyond an outer face 42 of the first end 16. A gear 44 is securely attached to that one end of the support shaft 26. The one end of the support shaft 26 is shown as being shouldered in several steps for accommodating the size of the shaft seal 22 and gear 44. The gear 44 is positioned on the shaft so that it will be aligned and meshed with a gear 44 of an opposing housing 12 when the motor body 14 is placed therebetween. It is to be noted that if the size of the gears permit, one or more of the shoulders may be eliminated.

A pair of sealing means 46 such as O-rings, Quad rings or the like are used to seal a mating surface of the motor body 14 with its associated outer face 42 of the housing 12. This sealing means 46 may be more clearly seen in FIG. 2.

Still referring to FIG. 2, the alignment of one housing with the other is provided by a pair of locating means 48 such as a dowel, spring pin or the like. The outer face 42 of the housing 12 includes a pair of threaded apertures 50 and a pair of non threaded apertures 52 as a fastening arrangement.

An inlet port 54 connects a source of hydraulic power with a high pressure side of a motor chamber 56 that is formed in the motor body 14. An outlet port 58 is configured for connecting a low pressure side of the motor chamber 56 with a hydraulic reservoir. The inlet port 54 and the outlet port 58 may be formed in only one of the housings 12 or alternatively-in both. When the ports are duplicated in each housing, it is necessary to block off any unused port with a threaded plug.

It can be seen that the meshed gears 33 will be rotated by the introduction of a hydraulic fluid under pressure. The rotation of the gears 44 will rotate the support shaft 26 and eccentrics 24.

It can also be seen that the arrangement disclosed in the present invention will provide a relatively economical construction by producing parts such as the housing 12 in quantity. The similarity of the housings lends itself to economies in inventory and assembly time. The apparatus of the present invention is also energy efficient due to the use of a minimal number of components.

The vibratory output of the assembly 10 may be adjusted between a minimum to a maximum by changing the relative position or phasing of the eccentric 24 of the first housing with the eccentric 24 of the other housing. The position of the eccentric 24 may be adjusted at assembly by meshing the gears 44 in a predetermined array. The position of one eccentric 24 with the other may be made after assembly. This second type of adjustment may require a covered access opening in the wall 40 of the housing 12. In this second type of adjustment one or both eccentrics 24 may be adjustably secured to the shaft, by a securing means, such as clamp type hub, set screws or the like. The securing means must be able to withstand the vibratory forces that will be generated by the assembly.

The housings 12 are fitted with a pair of integral mounting feet 60 with mounting apertures 62 therethrough. These mounting feet 60 provide a convenient means for attaching the assembly 10 to a host apparatus that is to be vibrated.

Directional terms such as "front", "back", "in", "out", downward, upper, lower and the like are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent 1hat the prior art allows.

What is claimed is:

1. A hydraulically driven vibrator apparatus comprising:

a motor body; and a pair of opposed housings, each housing of the opposed housings including a first end and a second end and having a cavity formed therebetween, said cavity being adapted for allowing a rotational orbit by an eccentric weight therein, the eccentric weight being secured to a support shaft and adapted for being rotated as the support shaft is rotated, the support shaft being rotatably carried by its associated housing of the pair of opposed housings, at least one pair of anti-friction bearings being carried in precision bores of its associated housing of each of the opposed housings, each of the anti-friction bearings being adapted for carrying the support shaft and its associated eccentric weight in a selected array, each of the anti-friction bearings being sized for withstanding anticipated vibratory forces; one end of the support shaft being arrayed for extending a selected distance beyond the first end, the one end of the support shaft having a gear member secured thereto;

wherein the pair of housings are arrayed in an opposed relationship with the motor body removably secured therebetween, the motor body being formed of a flat plate of a selected uniform thickness so that a first gear member of a first housing of the pair of opposed housings is aligned and meshed with a second gear member of the a second housing of the pair of opposed housings, the motor body having a motor chamber formed therein and therethrough, the motor chamber being formed to include a first radially contoured end portion and a second radially contoured end portion, the first radially contoured end portion being sized for closely paralleling a first outside diameter of the first gear member and the second radially contoured end portion closely paralleling a second outside diameter of the second gear member, the first and second gear members are aligned and meshed interior of the motor chamber to provide the simultaneous rotation of the support shaft and the eccentric weight associated with each of the pair of opposed housings, the simultaneous rotation occurring when a hydraulic fluid under a selected pressure flows through an inlet port of the apparatus, said inlet port directing the flow of the hydraulic fluid towards the motor chamber for rotating the first gear and second gear; and an exhaust means for carrying the hydraulic fluid under a reduced pressure from the motor chamber and subsequently away from the apparatus.

2. An apparatus as recited in claim 1 wherein the first end includes at least one sealing means for minimizing leakage of the hydraulic fluid from the motor chamber.

3. An apparatus as recited in claim 1 wherein a first bearing of the pair of bearings is rotatably carried in the first end of the housing, a second bearing of the pair of bearings is rotatably carried in the second end of the housing and the eccentric weight is arrayed between the first bearing and the second bearing.

4. An apparatus as recited in claim 3 wherein the first bearing has capacity for withstanding radial and thrust loading for retaining the one end of support shaft at selected position with respect to the first end.

5. An apparatus as recited in claim 3 wherein the second bearing is adapted for allowing a predetermined expansion and contraction of the support shaft in a direction parallel to its rotational axis.

6. An apparatus as recited in claim 1 wherein the eccentric weight of a first of the pair of housings is selectively phased with respect to the eccentric weight of a second of the pair of housings for varying the output of the apparatus between a minimum and a maximum.

7. An apparatus as recited in claim 6 wherein the first end includes at least one sealing means for minimizing leakage of the hydraulic fluid from the motor chamber.

8. An apparatus as recited in claim 6 wherein a first bearing of the pair of bearings is rotatably carried in the first end of the housing, a second bearing of the pair of bearings is rotatably carried in the second end of the housing and the eccentric weight is arrayed between the first bearing and the second bearing.

9. An apparatus as recited in claim 8 wherein the first bearing has capacity for withstanding radial and thrust loading for retaining the one end of support shaft at selected position with respect to the first end.

10. An apparatus as recited in claim 8 wherein the second bearing is adapted for allowing a predetermined expansion and contraction of the support shaft in a direction parallel to its rotational axis.

* * * * *